US005445759A

United States Patent [19]

Powell

[11] Patent Number: 5,445,759

[45] Date of Patent: Aug. 29, 1995

[54] PREPARATION OF ELECTRORHEOLOGICAL FLUIDS USING FULLERENES AND OTHER CRYSTALS HAVING FULLERENE-LIKE ANISOTROPIC ELECTRICAL PROPERTIES

[75] Inventor: Bob R. Powell, Birmingham, Mich.

[73] Assignee: General Motors Corporation, Detroit, Mich.

[21] Appl. No.: 58,815

[22] Filed: May 10, 1993

Related U.S. Application Data

[63] Continuation-in-part of Ser. No. 841,174, Feb. 25, 1992, abandoned.

[51] Int. Cl.[6] ..... C10M 171/00; C10M 169/04

[52] U.S. Cl. ..... 252/73; 252/74; 252/572

[58] Field of Search ..... 252/73, 74, 572

[56] References Cited

U.S. PATENT DOCUMENTS

| | | | |
|---|---|---|---|
| 4,744,914 | 5/1988 | Filisko et al. | 252/74 |
| 4,772,407 | 9/1988 | Carlson | 252/74 |
| 5,114,477 | 5/1992 | Mort et al. | 106/20 |
| 5,234,474 | 8/1993 | Whewell | 44/282 |

FOREIGN PATENT DOCUMENTS

| | | |
|---|---|---|
| 0361106 | 4/1990 | European Pat. Off. . |
| 0387857 | 9/1990 | European Pat. Off. . |
| 4-45196 | 2/1992 | Japan . |

OTHER PUBLICATIONS

Wragg et al, "Scanning Tunnelling Microscopy of Solid $C_{60}/C_{70}$," Letters to Nature, vol 348, 13 Dec. 1990, pp. 623–624.

Hauffler et al, "Efficient Production of $C_{60}$ (Buckminster fullerene), $C_{60}H_{36}$, and the Solvated Buckide Ion", J. Phys. Chem., 94, pp. 8634–8636, Nov. 1990.

Chemical Abstracts, 73(24): 124673y, "Aspects of Electric Field Action on a Suspension Containing a Nonpolar Medium", Krasikov et al, 1970.

Rosseinsky et al, "Superconductivity at 28 K in $Rb_xC_{60}$", Physical Review Letters, vol. 66, No. 21, 27 May 1991, pp. 2830–2832.

Pemisi, "Buckyballs Still Charm", Science News, vol. 140, Aug. 24, 1991, pp. 120–123.

Amato, "CBN Ball, Anyone?", Research News, Jan. 31, 1992.

Guo et al, "$Ti_8C_{12}$ +–Metallo–Carbohedrenes: A New Class of Molecular Clusters?", Reports pp. 1411 & 1412, Mar. 13, 1992.

Studt, "Researchers Uncover Met–Cars, A New Class of Materials", R&D Materials Science, R&D Magazine, Feb. 1993, pp. 50–52.

Browne, "Chemists' New Toy Emerges as Superconductors", Sep. 3, 1991, New York Times, p. C–1.

Curl et al, "Fullerenes", Scientific American, Oct. 1991, pp. 54–63.

Wilson et al, "Imaging $C_{60}$ clusters on a surface using a scanning tunnelling microscope", Letters to Nature, vol. 348, 13 Dec. 1990, pp. 621–624.

The American Heritage Dictionary, Second College Edition, (1976), p. 554, the Term "Geodesic Dome".

Brooks et al., "The Formation of Graphitizing Carbons From the Liquid Phase", Carbon, (1965), vol. 3, pp. 185–194.

Kroto, "Carbon Onions Introduce New Flavour To Fullerene Studies", News And Views, Nature, vol. 359, (22 Oct. 1992), pp. 670–671.

Ugarte, "Curling And Closure Of Graphitic Networks Under Electron–Beam Irradiation", Nature, vol. 359, (22 Oct. 1992), 707–709.

*Primary Examiner*—Christine Skane
*Attorney, Agent, or Firm*—Cary W. Brooks

[57] ABSTRACT

Disclosed are electrorheological fluids having spherical, or near-spherical, fullerene-type particles and a nonconducting or dielectric fluid.

13 Claims, 1 Drawing Sheet

PREPARATION OF ELECTRORHEOLOGICAL FLUIDS USING FULLERENES AND OTHER CRYSTALS HAVING FULLERENE-LIKE ANISOTROPIC ELECTRICAL PROPERTIES

This is a continuation-in-part of application Ser. No. 07/841174 filed on Feb. 25, 1992 now abandoned.

FIELD OF THE INVENTION

The present invention relates to fluid compositions which demonstrate significant changes in their flow properties in the presence of an electric field.

BACKGROUND OF THE INVENTION

Electrotheology is a phenomenon in which the rheology of a fluid is modified by the imposition of an electric field. Fluids which exhibit significant changes in their properties of flow in the presence of an electric field have been known for several decades. The phenomenon of electrotheology was reported by W. M. Winslow, U.S. Pat. No. 2,417,850, in 1947. Winslow demonstrated that certain suspensions of solids in liquids show large, reversible electrotheological effects. In the absence of an electric field, electrotheological fluids generally exhibit Newtonian behavior. That is, the applied force per unit area, known as shear stress, is directly proportional to the shear rate, i.e., change in velocity per unit thickness. When an electric field is applied, a yield stress appears and no shearing takes place until the shear stress exceeds a yield value which generally rises with increasing electric field strength. This phenomenon can appear as an increase in viscosity of up to several orders of magnitude. The response time to electric fields is on the order of milliseconds. This rapid response, characteristic of electrotheological fluids, makes them attractive to use as elements in mechanical devices.

A complete understanding of the mechanisms through which electrorheological fluids exhibit their particular behavior has eluded workers in the art. Many have speculated on the mechanisms giving rise to the behavior characteristics of electrorheological fluids.

A first theory is that the applied electric field restricts the freedom of particles to rotate, thus changing their bulk behavior.

A second theory ascribes the change in properties to the filament-like aggregates which form along the lines of the applied electric field. The theory proposes that this "induced fibrillation" results from small, lateral migrations of particles to regions of high field intensity between gaps of incomplete chains of particles, followed by mutual attraction of these particles. Criticism of a simple fibrillation theory has been made on the grounds that the electrorheological effect is much too rapid for such extensive structure formation to occur; workers in the art have observed a time scale for fibrillation of approximately 20 seconds, which is vastly in excess of the time scale for rheological response of electrorheological fluids. On the other hand, response times for fibrillation on the order of milliseconds have been observed.

A third theory refers to an "electric double layer" in which the effect is explained by hypothesizing that the application of an electric field causes ionic species adsorbed upon the discrete phase particles to move, relative to the particles, in the direction along the field toward the electrode having a charge opposite that of the mobile ions in the adsorbed layer. The resulting charge separation and polarization could lead to "dipole" interactions and fibrillation.

Yet another theory proposes that the electric field drives water to the surface of discrete phase particles through a process of electro-osmosis. The resulting water film on the particles then acts as a glue which holds particles together. If correct, then a possible sequence of events in fibrillation would be: ionic migration, subsequent electro-osmosis of moisture to one pole of the particle (presumably the cationic region) and bridging via this surface supply of water. However, the advent of anhydrous electrorheological fluids means that water-bridging is not an essential mechanism and may indeed not be operative at all.

Despite the numerous theories and speculations, it is generally agreed that the initial step in development of electrorheological behavior involves polarization under the influence of an electric field. This then induces some form of interaction between particles or between particles and the impressed electric or shear fields which results in the rheological manifestations of the effect. See Carlson, U.S. Pat. No. 4,772,407; and Block et al "Electro-Rheology", IEEE Symposium, London, 1985. Despite this one generally accepted mechanism, the development of suitable electrorheological fluids and methods of improving the same remains largely unpredictable.

The potential usefulness of electrotheological fluids in automotive applications, such as vibration damping, shock adsorbers, or torque transfer, stems from their ability to increase, by orders of magnitude, their viscosity upon application of an electric field. This increase can be achieved with very fast (on the order of milliseconds) response times and with minimal power requirements.

Although ER-fluids have been formulated and investigated since the early 1940's, basic limitations have prevented their utilization in practical devices. The most restrictive requirements are that (1) the suspensions be stable over time; i.e., that the solid particles either remain suspended in the liquid or be readily redispersed if sedimentation occurs and (2) service and durability of the suspensions can be achieved outside the temperature range of 0°–100° C. This latter requirement is particularly restrictive in that most fluid compositions require water as an ER "activator" so that in completely nonaqueous systems the ER-effect is entirely absent or so small that it is not effectively useful.

An object of this invention is to formulate a stable, substantially water-free, or nonaqueous ER-fluid with improved properties.

SUMMARY OF THE INVENTION

This invention generally includes electrorheological fluids having carbon molecules of unique spherical, or near-spherical, or closed-surface structures such that each molecule (particle) has high electrical conduction along and around its surface, but low conduction between adjacent particles due to high electrical resistance radially, through the surface. These particles may be prepared from carbon molecules known as fullerenes. A preferred family of such particles includes the $C_{60}$ molecules, also known as buckyballs. These molecules are hollow spheres formed of uniquely arranged five- and six-atom carbon rings. The arrangement yields a pattern that resembles a geodesic dome. Other similar, though not spherical, fullerenes are known, and are also included in this invention. It is believed that the structure of these materials is such that they are highly polarizable, i.e., the electrons are mobile in the surface of the particles, and these mobile electrons produce a charge separation (dipoles) in the surface of the particle in the presence of an externally applied electric field. Under the influence of the electric field, the dipoles of neighboring particles may interact resulting in chains of particles extending between the electrodes that produce the electric field. The effect of the field, then, is to cause the formation of the chains which in turn increases the viscosity of the fluid and increases the energy necessary to shear the fluid. These carbon particles have an electron conductivity that is sufficiently high to eliminate the need for water or other activators in the electrorheological fluid composition made from the same. Where the invention comprises anhydrous fluids, the elimination of the requirement for water in the electrorheological fluid increases the temperature range in which the electrorheological fluid may operate.

These and other objects, features and advantages of this invention will be apparent from the following brief description of the drawings, detailed description and appended drawings and claims.

DETAILED DESCRIPTION

Common graphite (i.e., planar graphite) displays anisotropic electronic conductivity: being three orders of magnitude greater in the direction parallel to the sheets ([001] planes) rather than perpendicular to them. When planar graphite is used in an electrorheological composition, it shorts almost immediately upon application of the field and draws a substantial amount of current. Thus, planar graphite is clearly undesirable for electrorheological fluid composition.

In contrast, the solid phase of an electrorheological fluid composition according to the present invention comprises spherical graphite particles. Suitable spherical graphite particles are disclosed in Pennisi, "Buckyballs Still Charm", Science News, Vol. 140, Aug. 24, 1991, the disclosure of which is hereby incorporated by reference. Suitable spherical graphite particles are available from Texas Fullerenes Corporation under the trade name "Fullerene Enriched Soot". Mixtures of fullerenes are suitable and particularly those which are mostly $C_{60}$ with about 15 to about 20 weight percent $C_{70}$ and may also include traces of $C_{84}$ or $C_{92}$.

Interestingly, these spherical shaped or near-spherical graphite particles manifest a high polarize ability due to electrical conduction around the spherical surface, but low conduction between particles due to the high resistance to conduction radially through the surface. These spherical shaped carbon particles do not short as do the planar shaped graphite.

A unique family of carbon molecules known as fullerenes are preferred for electrorheological fluid compositions according to the present invention. A particularly well known member of the family, $C_{60}$, are also known as buckyballs and are molecules in the form of a hollow sphere of five- and six- carbon atom rings arranged in a pattern that resembles a geodesic dome. These particles contain some of the properties of graphite, which consist of sheets of six-carbon atom rings. Unlike planar graphite, the spherical shaped graphite do not draw high current which is detrimental to ER-fluids because it increases the energy required of the fluid and causes heating of the fluid.

Figure 1:
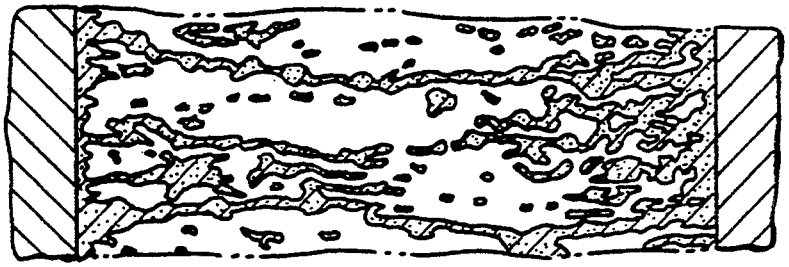
FIG. 1, is an illustration of a composition including $C_{60}$ in the presence of an electric field and exhibiting chain formation behavior.
Figure 2:
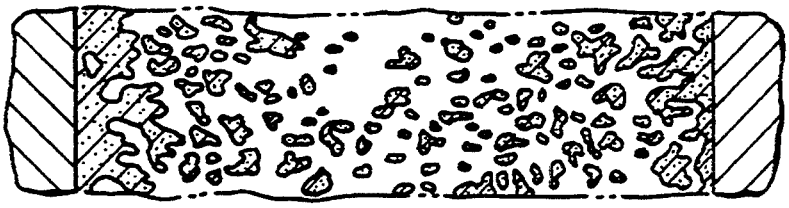
FIG. 2, is an illustration of a composition including $C_{60}$ in the absence of an electric field.

According to the present invention, carbon containing $C_{60}$ was obtained from Texas Fullerenes Corporation, purified, and suspended in mineral oil. Purification was accomplished by mixing the as-received materials and reagent-grade toluene, filtering the mixture through Whatman #41 filters, then through a 0.45 micron millipore filter, and removing the toluene from the filtrate by rotovaping. The fluid so prepared was mounted in a microscope between two copper electrodes. For comparison, fluids were also prepared with the as-received soot and a sample of planar graphite for evaluation in the microscope. The results are shown in Table I. The ER-fluid containing $C_{60}$ displayed electrotheological behavior as evidenced by chain formation as shown in FIG. 1. The current flow through the fluid was too low to be measured, with the limit of the instrument being 1 $\mu$A. The as-received soot which contains other fullerenes and carbon species, possibly planar, also showed chain formation, but drew a higher current, ranging from 0.05 to 0.3 mA. The planar graphite shorted immediately upon application of the field indicating that the current draw was in excess of 5 mA, the limit of the instrument. There was no chain formation in the absence of the electric field in any of the samples as shown in FIG. 2.

TABLE I

Evaluation of Carbon-Based Fluids for Electrorheological Behavior

| Sample | Applied Voltage, VDC | Current | Chain Formation |
|---|---|---|---|
| $C_{60}$ | 500 | $<1\ \mu$A | no |
| | 1000 | $<1\ \mu$A | yes* |
| | 1500 | $<1\ \mu$A | yes* |
| | 2000 | shorted | |
| as-received | 250 | not measured | no |
| soot | 500 | 0.05–0.35 mA | yes |
| planar | 250 | 3–5 mA | faint* |
| graphite | 500 | $>5$ mA | no |

*In cases where electrical shorting across the sample eventually occurred, a tendency to for chain formation preceded shorting.

Electrorheological fluid compositions according to the present invention provide a variety of advantages. The spherical shaped graphite material is relatively non-abrasive compared to the irregularly shaped oxide particles that are common in the ER fluids. The $C_{60}$ particles are stable with respect to settling of the suspended phase. These particles have a diameter less than 1 nm and as a result are well dispersed and do not settle because the thermal motion of the liquid keeps them suspended.

In an alternate form, the electronic properties of the electrorheological fluid may be tailored such that the electrorheological response may be increased by appropriate encapsulation of ions within the hollow sphere or adsorbed onto the surface. For example, $Rb_xC_{60}$ where x is approximately 3, is a superconductor at 28K. Method of making $Rb_xC_{60}$ is disclosed in Rosseinsky et al, "Superconductivity at 28 K in $Rb_xC_{60}$, " Physical Review Letter, Vol 66, No. 21 (May 27, 1991), the disclosure of which is hereby incorporated by reference. Thus, incorporation of such an ion, and possibly other ions, into the spherical shaped graphite particles may improve the electrorheological response thereof.

In a further alternate form, the electronic properties of the fullerenes in this invention may be analogously achieved in other materials such as conducting polymers or solid electrolyte, ion conductors. The salient feature of all of these materials being that the electronic or ionic conduction of the surface of the particles that is highly anisotropic; high parallel to the surface and low in the radial or perpendicular to the surface. To date, such materials, other than fullerenes, are unknown, but are nevertheless incorporated in this invention.

The particles may be present in the composition in an amount ranging from about 5 to about 50, and preferably about 15 to about 30 percent by volume of the composition the particles are suspended in a liquid phase including a dielectric material such as mineral oil or silicone oil. Preferably the liquid phase or dielectric material comprises about 50 to 95, and more preferably about 70 to 80 percent by volume of the composition. The particles or molecules have a structure and electrical property such that there is high electrical conduction along and around the surface of the particle or molecule and high electrical resistance radially through the particles. Thus, the particles or molecules do not require, and are free of any electrically insulating material or thin layer, less than 1/10th of the diameter of the particle or molecule, on the surface of the particle or molecule, in order to avoid shorting problems and to have reduced power consumption or current draw.

Preferably, the material of the solid phase is dried at a temperature ranging up to 200° C., but was not necessary in this case because water was not present in the formation of the fullerenes and the process for purifying the $C_{60}$ precluded water contamination. Thus, the particles are referred to as being substantially free of water. Preferably, the amount of water adhering to the particles is less than that required for the water to be an "activator" of the electrorheological response. That is, the amount of water adhering to the particle of the solid phase is not sufficient to create water bridges between particles under the influence of an electric field. The drying of the particle is carried out under low vacuum at constant pressure. Preferably the drying is at a pressure ranging from about 300 to about 50 mTorr, preferably about 200 to about 50 mTorr and most preferably 50 mTorr. The resultant, dry particles are then dispersed in a liquid phase. The liquid phase may comprise any suitable liquid phase known in the art but preferably is silicon oil or mineral oil.

The embodiments of the invention in which an exclusive property or privilege is claimed are defined as follows:

1. A method of changing the viscosity of an electrorheological composition comprising the step of applying an electric field across an electrorheological composition wherein said composition comprises particles comprising carbon atom rings arranged in a geodesic dome pattern having high electrical conduction along and around the surface of the particle and high electrical resistance radially through the particle so that said particles polarize without shorting, said step of applying an electric field being effective to produce an electrorheological response, said particles being present in an amount ranging from about 5 to about 50 percent by volume of the composition, and suspended in a liquid phase comprising a dielectric, said dielectric comprising about 5 to about 95 percent by volume of the composition.

2. A method as set forth in claim 1 wherein said particles are prepared from a material comprising a fullerene.

3. A method as set forth in claim 1 wherein said rings comprise at least one selected from the group consisting of five-carbon atom rings and six-carbon atom rings.

4. A method as set forth in claim 1 wherein said particles comprise $C_{60}$.

5. A method as set forth in claim 1 wherein said particles are hollow.

6. A method as set forth in claim 1 wherein said particles are present in an amount ranging from about 5 to about 30 percent by volume of said composition.

7. A method as set forth in claim 1 wherein said particles comprise $Rb_xC_{60}$ where x is approximately 3.

8. A method as set forth in claim 1 wherein said particles are arranged in a plurality of filament-like chains.

9. A method as set forth in claim 1 wherein said composition is anhydrous.

10. A method as set forth in claim 1 wherein said composition does not include other electrorheological response activators.

11. A method as set forth in claim 1 wherein said particles comprise buckyballs.

12. A method of changing the viscosity of an electrorheological composition comprising applying an electric field to an electrorheological composition comprising carbon rings wherein said rings are arranged in a pattern of at least one selected from the group consisting of spherical and near-spherical hollow structures and a dielectric liquid phase to produce an electrorheological response, said carbon rings being present in an amount ranging from about 5 to about 50 percent by volume of the composition and said dielectric liquid phase being present in an amount ranging from about 50 to 95 percent by volume of the composition, and so that ionic conduction on the surface of the structures is high relative to ionic conduction through the structure.

13. A method of changing the viscosity of a composition comprising applying an electric field to an electrorheological composition comprising fullerene particles and a dielectric phase to produce an electrorheological response, said fullerene particles being present in an amount ranging from about 5 to about 50 percent by volume of the composition and said dielectric liquid phase being present in an amount ranging from about 50 to 95 percent by weight of the composition.

* * * * *

UNITED STATES PATENT AND TRADEMARK OFFICE

CERTIFICATE OF CORRECTION

PATENT NO. : 5,445,759

DATED : August 29, 1995

INVENTOR(S) : Bob R. Powell

It is certified that error appears in the above-identified patent and that said Letters Patent is hereby corrected as shown below:

At column 2, line 28 delete "electrotheological" and insert

— electrorheological —.

Signed and Sealed this

Fifth Day of March, 1996

Bruce Lehman

*Attest:*

BRUCE LEHMAN

*Attesting Officer*

*Commissioner of Patents and Trademarks*